US005110256A

United States Patent [19]

Groenendaal, Jr.

[11] Patent Number: 5,110,256

[45] Date of Patent: May 5, 1992

[54] METHODS AND APPARATUS FOR ATTACHING A FLOW GUIDE TO A STEAM TURBINE FOR RETROFIT OF LONGER ROTATIONAL BLADES

[75] Inventor: John C. Groenendaal, Jr., Winter Springs, Fla.

[73] Assignee: Westinghouse Electric Corp., Pittsburgh, Pa.

[21] Appl. No.: 653,573

[22] Filed: Feb. 11, 1991

[51] Int. Cl.[5] ..... F01D 9/04; F01D 3/02

[52] U.S. Cl. ..... 415/190; 415/194; 415/103

[58] Field of Search ..... 415/189, 190, 191, 196, 415/208.1, 209.2, 209.3, 211.2, 101, 103

[56] References Cited

U.S. PATENT DOCUMENTS 4,900,223 2/1990 Groenendaal, Jr. ..... 415/190

*Primary Examiner*—Edward K. Look
*Assistant Examiner*—Michael S. Lee

[57] ABSTRACT

Improved methods and apparatus for retrofitting longer last row rotational blade assemblies in steam turbines are disclosed. The apparatus of the present invention permits the exhaust flow guide to be mounted directly to modified last row stationary turbine blades. In a preferred embodiment, the outer blade ring of the last row of stationary blades in a steam turbine is modified by machining two grooves which permit a modified blade assembly outer ring and integral blade ring extension to be mounted in the turbine. The extension section is configured to accept connecting means, such as bolts, which permit the direct attachment of an exhaust flow guide to the modified outer blade ring at each end of the turbine. The present invention simplifies the attachment of such flow guides and can improve the harmonic characteristics of the turbine by lowering the natural frequency of the assembly and include the mass of the flow guide in the mass of the stationary blade assemblies. Methods of modifying steam turbines to add longer last row blades are also disclosed.

9 Claims, 3 Drawing Sheets

METHODS AND APPARATUS FOR ATTACHING A FLOW GUIDE TO A STEAM TURBINE FOR RETROFIT OF LONGER ROTATIONAL BLADES

The present invention relates to steam turbines. More particularly, the present invention relates to low pressure steam turbines wherein steam generally flows axially through rows of radially extending stationary blades supported by outer blade rings and rotatable blades mounted on a rotor.

BACKGROUND OF THE INVENTION

Steam turbines represent a large capital expenditure both in terms of the turbine itself and the operative apparatus which the turbine drives. Thus, it is almost always more efficient and cost effective to retrofit or otherwise improve the performance of existing turbines through modification, rather than replacement. As pointed out in U.S. Pat. No. 4,900,223—Groenendaal, Jr., which is incorporated herein by reference, modernizing older steam turbines frequently includes installing longer last row blades to increase the annulus area or flow area at the turbine exhaust. The retrofit of such longer blades results in both improved efficiency and increased power output.

It has been found, however, that the increased blade length causes interference with existing structural elements of the steam turbine. As disclosed by the above-referenced patent, the blade carrier ring of the inner housing of the turbine must be machined to establish a new profile on the ring of the stationary blade assembly and inner housing. An assembly groove for the stationary blade assembly is also machined into the new profile. In this type of retrofit, however, the flow guide is attached to the inner housing by a series of spacers and bosses, using both bolted and welded connections. As disclosed in the above-referenced patent, a drilled circular boss is welded to the end wall of the inner housing and further secured by bolts, the machined cuts described above are made, and a spacer ring is added. The flow guide is then attached with the spacer ring using a series of additional bolts.

Although the structure described in the above-referenced patent permits longer blade rows to be added to existing turbines, numerous difficulties have been found to exist. The above-described retrofit is complex and time-consuming, requiring a number of machining steps and the addition of further structural elements to the turbine. Additionally, after the turbine is fitted with longer last row blades, problems which result from the flow guide being attached to the turbine housing still exist. For example, the mass of the flow guide acts independently of the mass of the blade assembly, thereby creating a limitation in mass distribution that makes it difficult to adjust the natural frequency of the structure. If the natural frequency of the flow guide or blade assembly is at or near the turbine running speed, undesirable harmonic vibrations occur, possibly resulting in excessive stresses and, ultimately, in the cracking of the blade assemblies or flow guide.

SUMMARY OF THE INVENTION

As a solution to the problems and shortcomings found in the prior art, the present invention provides an improved means for installing longer last-row blades into existing inner cylinders in low pressure steam turbines. By providing an extended outer ring structure integral with the stationary blade assembly, the exhaust flow guide may be attached to the outer ring of the welded stationary blade assembly. The present invention thus provides a location to which the exhaust flow guide may be easily installed. Additionally, blade assemblies made in accordance with the present invention are more easily tuned to frequencies lower than the turbine running speed since the mass of the flow guide and the outer ring extension is included with the mass of the blade assembly. Problems of structural complexity and limitations in tuning the natural frequency of the assembly found in prior art designs caused difficulty particularly when the turbine was retrofit. However, these limitations created by the flow guide being attached to the outer ring of the turbine housing rather than to the outer ring of the stationary blade assembly are avoided by the present invention.

Accordingly, the present invention provides apparatus for use in a steam turbine having two ends adapted to exhaust steam through a flow guide. Preferably, the steam turbine will have an inner housing enclosing one or more sets of circularly disposed rotatable blades affixed to a central shaft. The inner housing will also enclose one or more sets of circularly disposed stationary blade assemblies affixed to an outer blade carrier ring, each residing in a circumferential groove in the inner housing. In accordance with the principles of the present invention, the steam turbine described is modified to include at least one set of additional rotatable blades disposed at each of the ends of the turbine which have a relatively greater length than the existing rotatable blades. Additionally, a modified last stationary blade assembly is provided which comprises an outer ring extension integral with the outer ring and also having connecting means for attaching the flow guide to the outer ring extension. Preferably, the modified steam turbine also includes the inner housing being modified to comprise at least one surface sloped relative to the horizontal axis of the turbine in order to provide clearance for the outer ring extension. Upon assembly, the retrofitted flow guide is positioned in close proximity to the tips of the retrofitted rotatable blades and the modified steam turbine will thus provide improved performance.

In a preferred embodiment the connecting means for attaching the flow guide to the outer ring extension comprises one or more bolted connections. Thus, most preferably, the outer ring extension will be provided with a plurality of threaded holes and the flow guide will similarly be provided with a flange having a plurality of through holes. Upon assembly, the threaded holes will be in registration with the through holes and a plurality of bolts will form the bolted connection.

The present invention also discloses methods for modifying steam turbines of the type described herein, comprising the steps of installing at each end of the turbine at least one set of additional rotatable blades having a relatively greater length than the existing rotatable blades. The methods of the present invention also include modifying the stationary blade assembly by machining a first profile cut and a second cut to restore the circumferential groove in which the outer blade ring resides. An outer ring extension integral with the outer ring is then provided and the flow guide is attached to the outer ring extension, preferably by bolting, resulting in the flow guide being in close proximity to the tips of the additional rotatable blades. In order to modify the inner housing, methods in accordance with the present invention preferably include the step of machining the first profile cut to create at least one surface sloped relative to the horizontal axis of the turbine, thereby providing clearance for the outer ring extension.

The present invention is of course also useful within new apparatus in addition to being a retrofit modification. In these applications, the turbine casing will not have to be redesigned, thereby resulting in cost savings.

DETAILED DESCRIPTION OF THE PREFERRED EMBODIMENTS

Figure 1:
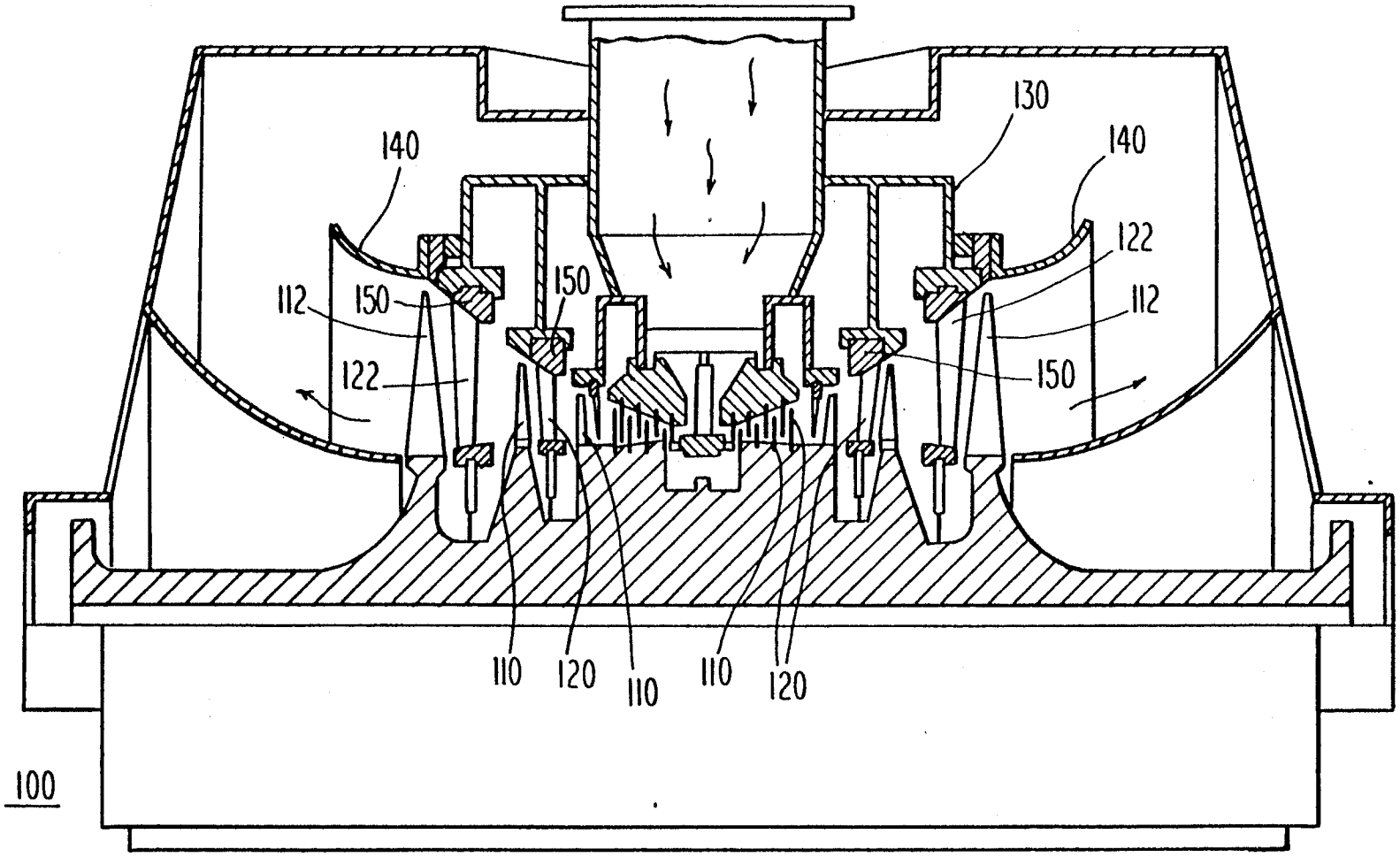
PRIOR ART Fig. 1
FIG. 1 is a longitudinal cross-section of a prior art steam turbine assembly.

Referring to FIG. 1, there is shown a longitudinal cross-section of a low pressure steam turbine 100 found in the prior art. The functioning of the type of turbine 100 depicted herein is well known to those of ordinary skill and is described in U.S. Pat. No. 4,900,223—Groenendaal, Jr., which is incorporated herein by reference. The steam turbine 100 comprises a plurality of rows of rotating turbine blades 110 symmetrically disposed about the center of the turbine 100. It will be understood that in the view shown, only one-half of the cross-section of each turbine is shown. The rotating blades 110 are affixed to a central shaft which extends to either end of the turbine 100. Interposed between the rotating blades 110 are stationary welded blade assemblies 120 affixed to the inner housing 130 of the turbine 100. The welded blade assemblies 120 are terminated by an outer blade ring 150 which is disposed in a circumferential groove in the inner housing 130.

In most current turbine designs, longer last rotational blades 112 are provided in a retrofit modification to increase turbine efficiency and power output. Adjacent to the longer last row rotational turbine blades 112 are the last stationary blade assemblies 122, which are affixed to either end of the inner housing 130 and similarly terminated by an outer ring 150. An exhaust flow guide 140 is also typically attached to the inner housing 130 at either end.

Figure 2:
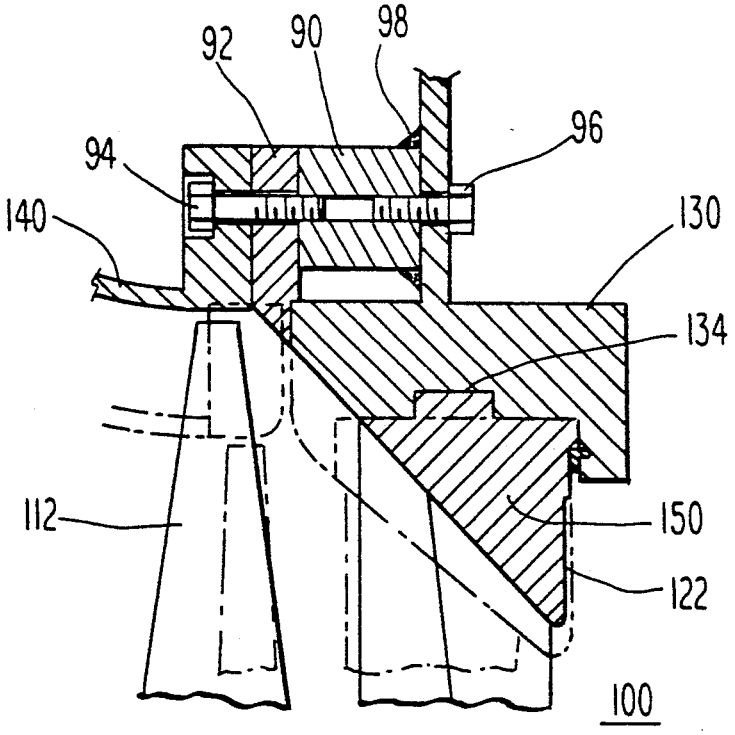
PRIOR ART Fig. 2
FIG. 2 is a broken away, partially cross-sectioned view of the last row of stationary blades, the longer retrofit rotational blades and related structural elements of the turbine depicted in FIG. 1 and similar prior art turbines.

A detailed view of the structure of the longest rotational blade 112, the last row stationary blade 122, the inner housing 130 and the flow guide 140 of a prior art turbine assembly such as that shown in U.S. Pat. No. 4,900,223 are shown in FIG. 2. Illustrated in phantom in FIG. 2 are the original positions and profiles of these components prior to modification. It will be observed that the additional length of the longer rotational blade 112 would have created interference with the original position of the exhaust flow guide 140. The flow guide 140 is therefore moved to the non-interfering position illustrated, however, this also moves the flow guide 140 away from its original mounting location against the face of the inner housing 130. The flow guide 140 is therefore mounted as shown, using additional components, discussed below, to provide attachment to the inner housing 130. In order to create a smooth transitional flow surface, the face of the inner housing 130 must be machined to a new profile, as illustrated. An additional machining step is also necessary to create a mounting groove 134 in which the outer blade ring 150 of the last stationary blade assembly 122 resides. As illustrated in FIG. 2, the solution to this problem disclosed in U.S. Pat. No. 4,900,223—Groenendaal, Jr., involved providing a boss 90 which was welded in position against the structure of the inner housing 130 by welds 98 as shown. A bolt 96 was also provided to secure the boss 90 if the welds 98 fail. A specially machined spacer ring 92 was then placed against the bosses 90 and thus formed an extended outer ring which was connected to the inner housing 130 by the bosses 90. The flow guide 140 was then attached using a second bolt 94 which passed through the flow guide 140, the spacer ring 92 and a boss 90, and was threaded into the inner housing 130. Although this solution to the problem provided an attachment point for the flow guide 140, it will be appreciated by those of ordinary skill that this was a less than optimal solution. The attachment of the flow guide 140 disclosed required several additional machined components which were assembled using pairs of bolts. Additionally, the boss 90 was welded in place which created the potential for deforming the inner housing 130, as well as creating non-stress relieved welds 98 which have low endurance strength.

The present invention overcomes these problems and provides an improved means for attaching longer last row rotational blades as a retrofit modification to an existing low pressure steam turbines. The methods and apparatus disclosed simplify blade attachment and result in the flow guide being attached to the blade assembly outer ring 150, instead of to the inner housing 130.

Figure 3:
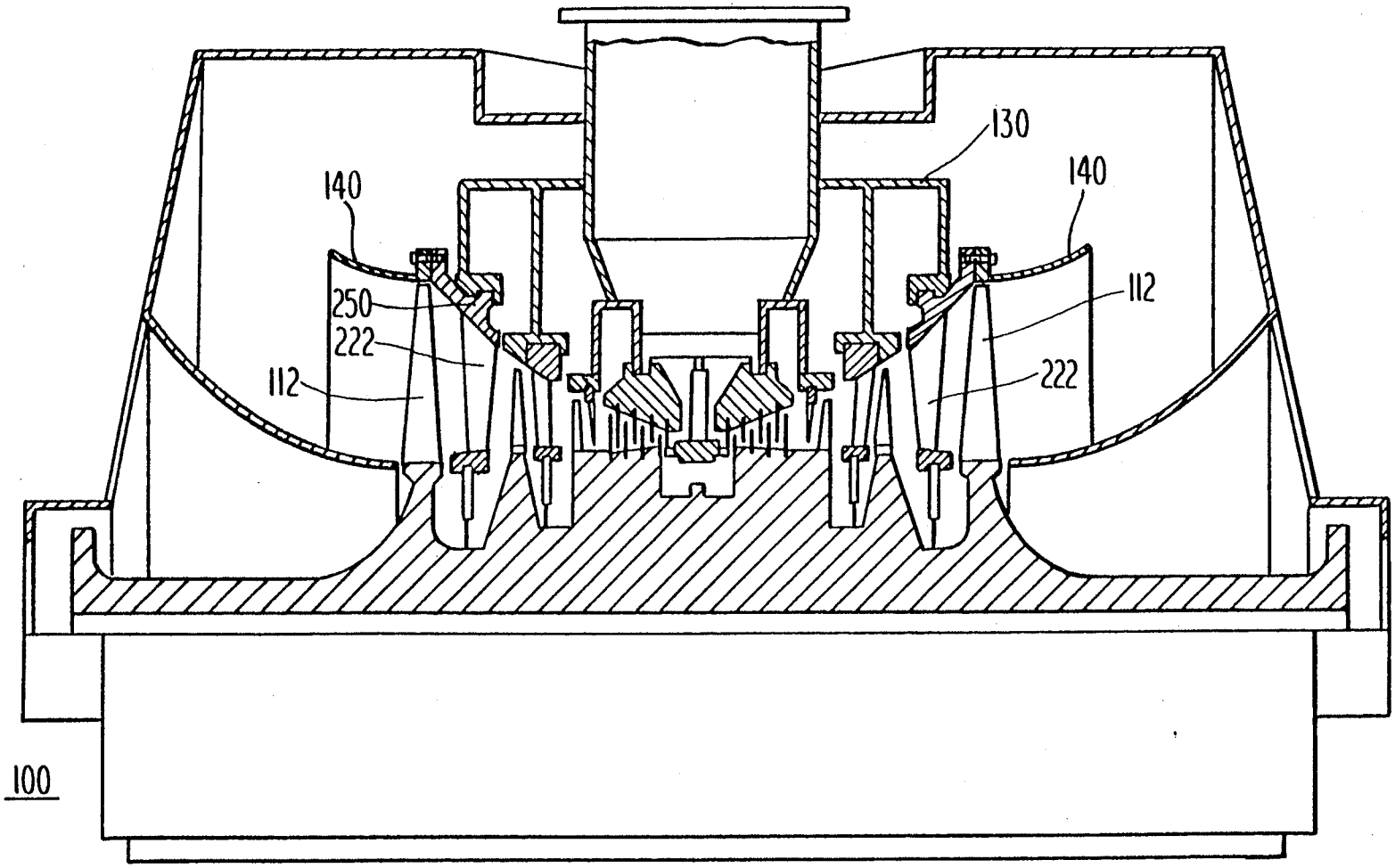
FIG. 3 is a longitudinal cross-section of a steam turbine assembly made in accordance with the present invention.

Referring to FIG. 3 a typical installation using the present invention is shown. The turbine assembly 100 is shown in cross-section and is substantially the same as that shown in FIG. 1. Longer rotational blades 112 are installed in a manner similar to that described above, again requiring that the exhaust flow guide 140 be positioned where shown. However, the steam turbine assembly 100 depicted in FIG. 3 differs from that depicted in FIG. in that a novel stationary blade assembly 222 and mounting ring structure 250 is provided at each end of the turbine 100, as shown. It will be immediately noted that the stationary blade structure 222 and the outer ring 250 mounted thereto provide a mounting point for the flow guide 140 and thus, the flow guide 140 is not directly mounted to the inner housing 130 or other structure of the turbine assembly 100. The present invention simplifies the mounting of the flow guide 140 and eliminates the additional components and welds required by the prior art. Additionally, the flow guide 140 is therefore included in the mass of the stationary blades assemblies 222 and can be accounted for when dynamically tuning the turbine to prevent the natural frequency of the assembly from coinciding with the operating speed. This reduces the likelihood that damaging harmonic vibrations will be generated during operation.

Figure 4:
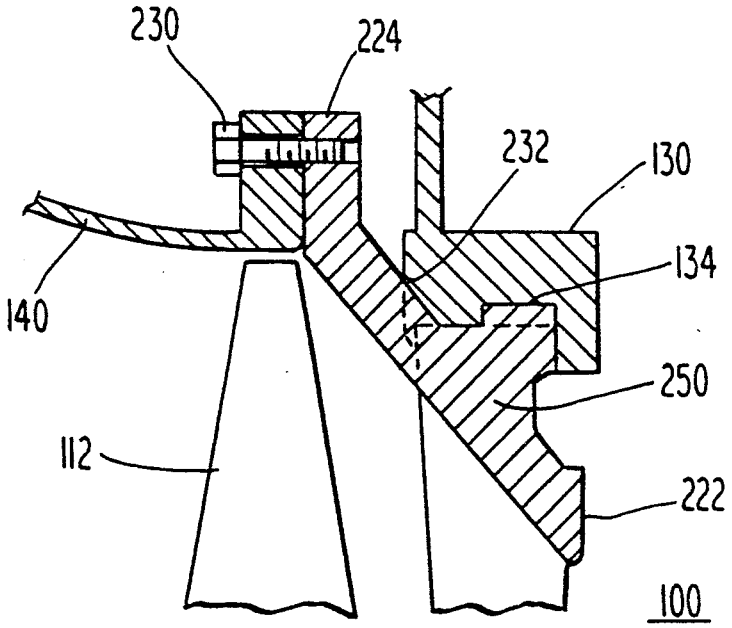
FIG. 4 is a broken away, partially cross-sectioned view of the last row of stationary blades, the longer retrofit rotational blades and related structural elements of the turbine depicted in FIG. 3.

A detailed view of the flow guide attachment provided by the present invention is shown in FIG. 4. As explained above with reference to FIG. 2, in order to accommodate the longer rotational blades 112 added during retrofit modifications, the inner housing 130 must first be machined to a new profile. In order to create an appropriate mounting surface, two cuts are made in the inner housing 130. The first cut creates an a profiled edge 232 which is angled relative to the horizontal axis of the turbine assembly 100, and a second cut preferably forms a substantially rectangular mounting groove 134, as shown. The second cut thus provides an assembly mounting groove 134 which retains the stationary blade ring 250, while the first cut allows clearance for the outer ring extension section 224 of the stationary blade structure 222 to extend to the location required to accommodate the larger rotational blade 112, and also provide a point of attachment for the flow guide 140. The outer ring extension section 224 of the present invention provides a structure whereby the exhaust flow guide 140 may be attached by a simple connection using a means for fastening such as the bolt 230 illustrated.

One of ordinary skill will appreciate the structurally simplified and overall improved attachment of the present invention. The present invention provides a simpler and faster retrofit installation of longer rotational blades 112 and the flow guide 140, while utilizing fewer parts than the structures disclosed in the prior art. The present invention reduces the number of bolts or other fastening means required by about one-half, and eliminates the bosses and spacer ring described above which were required by the prior art. The present invention also completely eliminates the need for welding and thereby eliminates the possibility of warpage, shrinkage or other distortions which might otherwise occur. Additionally, as pointed out above, the elimination of welds also provides the additional benefit of eliminating the occurrence of failures associated with non-stress relieved welds, which have inherently low endurance strength.

The present invention provides a readily installed attachment location for the flow guide 140 which is integral with the stationary blade structure 222 and does not require spacers, bosses or other components, such as those disclosed in the prior art. Those of ordinary skill will appreciate that the present invention reduces retrofit outage time since the longer blades and a modified flow guide are more easily installed. Although attaching the flow guide to the blade assembly is known to provide benefits, the present invention uniquely combines an extension of the outer ring 250 and extension section 224 which form part of the stationary blade structure 222 and thereby permit longer than normal last row rotational blades 112 blades to be installed in steam turbines 100.

In addition to structural simplicity, the present invention also provides a fundamental improvement over the prior art designs described above by attaching the exhaust flow guide 140 directly to the stationary blade assembly 222 at either end of the turbine 100 by means of an integral extended outer extension 224. The present invention provides an enhanced capability to tune the stationary blade assemblies 222 since the mass of the flow guide 140 is now included in the mass of the stationary blade assemblies 222. The present invention thus lowers the natural vibrational frequency of the stationary blade assembly by increasing its mass. The lowered natural frequency enables turbines made in accordance with the present invention to avoid problems associated with vibration induced cracking. In certain prior art turbines, vibrations are caused by the natural frequency approaching or coinciding with the turbine running speed, e.g., 60 Hz for fossil fuel turbines, 30 Hz for nuclear power. These vibrations may induce cracks in the welds which secure the blade foils within the welded stationary blade assemblies 222. This problem has been noted in the instance of turbines powered by nuclear energy, which have a lower running speed and larger components which have inherently lower natural frequencies. The present invention can provide a useful option for lowering the natural frequency of the stationary blade assemblies 222 away from the running speed or "low-tuning" the structure.

Although certain embodiments of the present invention have been described above with particularity, these embodiments are exemplary and not meant to limit the scope of the present invention. Numerous variations and departures from the examples set forth above will immediately present themselves to those of ordinary skill. Accordingly, reference should be made to the appended claims in order to ascertain the scope of the present invention.

What is claimed is:

1. A steam turbine having two ends adapted to exhaust steam through a flow guide, the steam turbine comprising at least an inner housing enclosing one or more sets of circularly disposed rotatable blades affixed to a central shaft, and one or more sets of circularly disposed stationary blade assemblies affixed to an outer blade ring residing in a circumferential groove in the inner housing, the steam turbine further comprising:

at least one retrofit set of rotatable blades disposed at each of the ends of the turbine and having a relatively greater length than the said rotatable blades; and a modified stationary blade assembly comprising an outer ring extension section integral with an outer ring and connecting means for attaching the flow guide to the outer ring extension, wherein said inner housing is modified to comprise at least one surface sloped relative to a horizontal axis of the turbine to provide clearance for said outer ring extension section, and whereby the flow guide is in close proximity to the tips of the retrofit rotatable blades.

2. The steam turbine of claim 1, wherein said connecting means for attaching the flow guide to the outer ring extension comprises one or more bolted connections.

3. The steam turbine of claim 2, wherein said outer ring extension further comprises a plurality of threaded holes and said flow guide further comprises a flange having a plurality of through holes, whereby said threaded holes are placed in registration with said through holes and a plurality of bolts form said bolted connection.

4. In a steam turbine comprising:

an inner housing having two ends;

a flow guide positioned at each end of the inner housing;

one or more sets of circularly disposed rotatable blades affixed to a central shaft; and one or more sets of circularly disposed stationary blade assemblies affixed to an outer blade ring residing in a circumferential groove in the inner housing;

the steam turbine being modified to further comprise:

at least one retrofit set of rotatable blades disposed at each of the ends of the turbine and having a relatively greater length than the said rotatable blades;

a modified stationary blade assembly comprising outer ring extension integral with an outer ring and connecting means for attaching the flow guide to the outer ring extension; and at least one surface of the inner housing sloped relative to the horizontal axis of the turbine to provide clearance for said outer ring extension means whereby the flow guide is in close proximity to the tips of the retrofit set of rotatable blades.

5. The steam turbine of claim 4, wherein said connecting means for attaching the flow guide to the outer ring extension comprises one or more bolted connections.

6. The steam turbine of claim 4, wherein said outer ring extension means further comprises a plurality of threaded holes and said flow guide further comprises a flange having a plurality of through holes, whereby said threaded holes are placed in registration with said through holes and a plurality of bolts form said bolted connection.

7. A method of modifying a steam turbine having two ends adapted to exhaust steam through a flow guide, the steam turbine comprising at least an inner housing enclosing one or more sets of circularly disposed rotatable blades affixed to a central shaft, and one or more sets of circularly disposed stationary blade assemblies affixed to an outer blade ring residing in a circumferential groove in the inner housing, the steam turbine modification comprising the steps of:

installing at each end of the turbine at least one retrofit set of rotatable blades having a relatively greater length than said rotatable blades; and modifying the stationary blade assembly by machining a first profile cut and a second cut to restore said circumferential groove;

providing outer ring extension means integral with an outer ring; and attaching the flow guide to the outer ring extension, whereby the flow guide is in close proximity to the tips of the additional rotatable blades.

8. The method of claim 7, wherein said first profile cut modifies the inner housing to comprise at least one surface sloped relative to the horizontal axis of the turbine, thereby providing clearance for said outer ring extension.

9. The method of claim 7, wherein said step of attaching the flow guide comprises bolting the flow guide to the outer ring extension.

* * * * *